US009381516B2

(12) United States Patent
Sharpe et al.

(10) Patent No.: US 9,381,516 B2
(45) Date of Patent: Jul. 5, 2016

(54) VIAL TRANSPORT ELEMENT AND ASSEMBLY

(71) Applicants: Gary Sharpe, Naples, FL (US); Brian Dutro, Columbus, OH (US); Lacey Fenner, Hilliard, OH (US)

(72) Inventors: Gary Sharpe, Naples, FL (US); Brian Dutro, Columbus, OH (US); Lacey Fenner, Hilliard, OH (US)

(73) Assignee: Gary L. Sharpe, Naples, FL (US)

( * ) Notice: Subject to any disclaimer, the term of this patent is extended or adjusted under 35 U.S.C. 154(b) by 0 days.

(21) Appl. No.: 14/458,383

(22) Filed: Aug. 13, 2014

(65) Prior Publication Data

US 2015/0209790 A1 Jul. 30, 2015

Related U.S. Application Data

(63) Continuation-in-part of application No. 29/480,484, filed on Jan. 27, 2014, now Pat. No. Des. 743,572.

(51) Int. Cl.

| | |
|---|---|
| ***B01L 9/06*** | (2006.01) |
| ***A61J 1/16*** | (2006.01) |
| ***B65D 81/02*** | (2006.01) |

(52) U.S. Cl.

CPC .... *B01L 9/06* (2013.01); *A61J 1/16* (2013.01); *B65D 81/022* (2013.01); *B01L 2200/082* (2013.01); *B01L 2200/087* (2013.01); *B01L 2200/12* (2013.01); *B01L 2200/18* (2013.01); *Y10T 29/49826* (2015.01)

(58) Field of Classification Search

CPC ..... A61J 1/16; B01L 9/06
USPC ..... 422/562
See application file for complete search history.

(56) References Cited

U.S. PATENT DOCUMENTS

| | | | | |
|---|---|---|---|---|
| 3,072,362 | A | 1/1963 | Allen | |
| 4,944,924 | A * | 7/1990 | Mawhirt | G01N 35/021 206/446 |
| 5,397,542 | A * | 3/1995 | Nelms | B01L 9/06 220/23.4 |
| 5,651,941 | A * | 7/1997 | Stark | B01L 9/06 220/676 |
| 6,001,310 | A * | 12/1999 | Shaffer | B01L 3/5085 422/548 |
| 6,015,246 | A | 1/2000 | Yamane | |
| 7,097,391 | B1 | 8/2006 | Keller | |
| 7,132,082 | B2 | 11/2006 | Aviles | |
| 2008/0075634 | A1 * | 3/2008 | Herchenbach | B01L 9/06 422/400 |

* cited by examiner

*Primary Examiner* — Paul Hyun
(74) *Attorney, Agent, or Firm* — Standley Law Group LLP

(57) ABSTRACT

An element and a vial transport assembly made of a plurality of elements pivotally joined together to form a unitary row for storing and transporting vials and other such containers is disclosed. The assembly comprises a vial gripper removably seated on an inner face of the element. The unitary row of elements may be pivoted together to a closed position to secure the vials therein, and in some embodiments includes complementary magnets arranged to secure adjacent elements in registration when in the closed position.

20 Claims, 3 Drawing Sheets

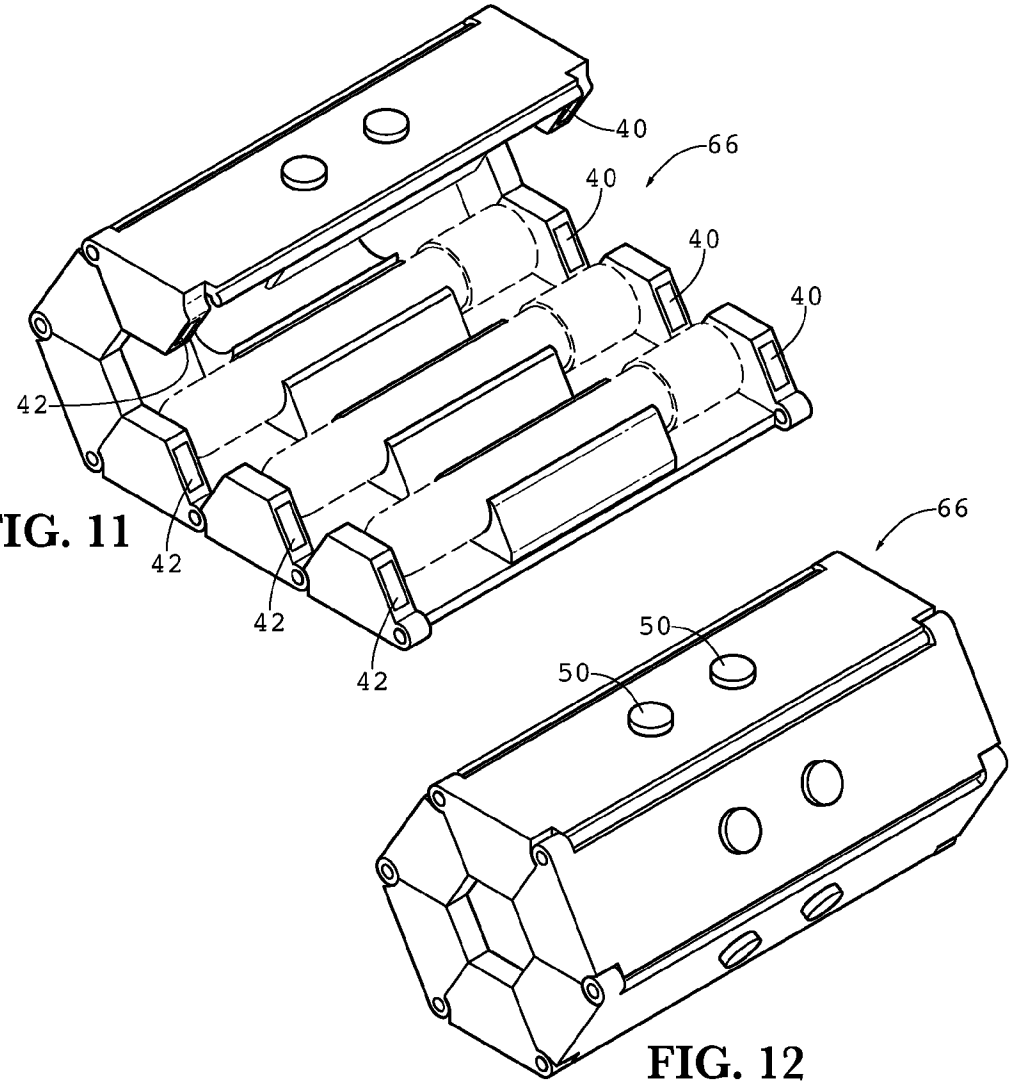
FIG. 11
FIG. 12
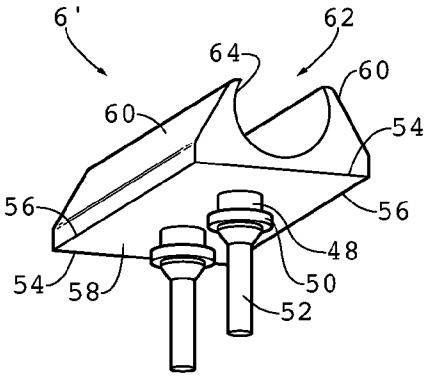
FIG. 10
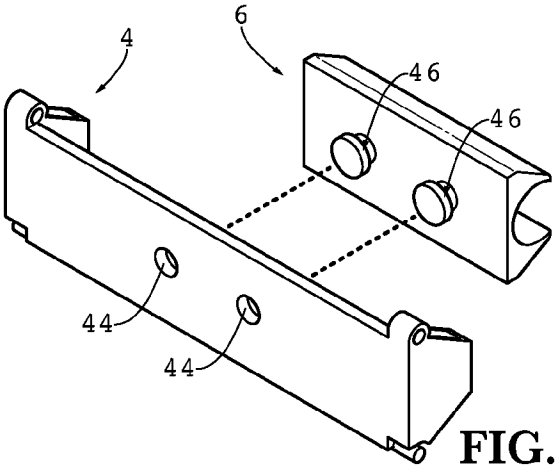
FIG. 9

VIAL TRANSPORT ELEMENT AND ASSEMBLY

CROSS-REFERENCE TO RELATED APPLICATIONS

This application claims priority to U.S. Design patent application No. 29/480,484 filed 27 Jan. 2014, the content of which is hereby incorporated by reference as if fully recited herein.

TECHNICAL FIELD

Exemplary embodiments of the present invention relate generally to mechanical devices, and more particularly to assemblies and elements thereof for holding, securing, protecting and transporting vials and other such vessels.

BACKGROUND OF THE INVENTION

Vessels of various types are known in the art for holding liquids, solutions, powders and numerous other materials. In the medical field, liquid, powder, capsule, and other forms of medication are often stored in vessels typically referred to as vials, which commonly take the form of a small, closed glass or plastic vessel. Vials may also be used in the field for storing biological materials such as blood samples and other bodily fluids and the like. Vials may be configured with screw-on caps, press-on caps, caps penetrable to pipette tips or needles, and other such varieties of lids generally depending upon intended use.

Vials must often be stored or transported during use. Many medications and biological materials must be stored in temperature controlled environments to avoid negative effects on efficacy or the general integrity of the materials. Similarly, vials are often transported from storage to the location at which the medication is to be administered, for example, or from the procurement site of the materials (e.g., blood) to storage or a testing laboratory. In medical settings, such as at a hospital, several vials may be needed for administration to a patient or several patients. Several kinds of medication may be required, or several vials each containing one dose of medication may be necessary during medical treatment.

It is known to utilize vial trays, boxes and other similar structures, sometimes contained within a carrying case, to transport multiple vials. Known structures typically include at least one surface with apertures sized to receive vials therein, and to maintain them in a substantially lid-up vertical position. These devices can be carried on a shoulder strap, placed on a wheeled cart, or carried by simple hand grips. Some carriers include additional vial retention means for retaining the vials within the apertures, or alignment features for use with common laboratory testing equipment, as disclosed in U.S. Pat. No. 7,132,082 to Aviles et al.

While known vial carrier configurations advantageously allow for the transport or storage of multiple vials simultaneously, they are not helpful in intra-facility transport by way of pneumatic tube systems. Many medical facilities use pneumatic tube systems, typically with cylindrical containers, in order to quickly transport materials between locations in a medical facility, including pharmaceuticals and biological materials. Traditional vial carriers are often much larger than and are incompatible with pneumatic tube sizes. In order to transport vials utilizing such systems, therefore, vials are typically placed directly into pneumatic tube containers, or into protective sleeves designed to fit securely within such containers.

In the former case in which the vials are placed directly into a pneumatic container, damage can occur to the vials as a result of the forces exerted on them as the pneumatic container traverses the tube systems. Manufacturers of vials have designed more robust vials in response, resulting in a significant expense to the users, who alternatively must deal with the increased risk and incidence of vial breakage during transport.

In the latter case, protective sleeves are used during pneumatic transport of vials to protect the vials from damage. An exemplary vial sleeve is disclosed in U.S. Pat. No. 3,072,362 to Allen, for example. While this development provided advantageous protection to vials in transport without the need for more robust vials, the sleeves have a disadvantage in that each embodiment must be manufactured to fit a particular vial shape and size configuration. Furthermore, the insertion and removal of the vials from the sleeve encourages contact with the lid portion of the vials, thereby introducing an increased risk of contamination due to unnecessary handling.

It is also known to provide elastic holding films within pneumatic containers for the purposes of suspending articles therein to avoid contact with the interior container surfaces during pneumatic transport. U.S. Pat. No. 6,015,246 to Yamane et al. discloses one such system in an effort to protect articles being transported within pneumatic systems. Such systems have advantages similar to protective sleeves, and potentially may be used with a wider variety of vial sizes. However, the elastic holding films do not make suitable storage or transport systems outside of the context of pneumatic tube transport. For example, the complexities of manufacturing such devices increases as multiple sub-compartments (and multiple elastic films) are required for transporting multiple vials. Furthermore, such devices do not provide for uniform orientation of vials—a disadvantage borne by the goal of such systems to be compatible with multiple types and sizes of articles.

It is therefore an unmet need in the prior art for a vial transport assembly that provides for the protection of a plurality of vials during both storage and transport, and that is useful both within existing pneumatic transport systems and outside of said systems. Further, it is needed for such a system to also be readily able to secure vials of varying types and sizes and to provide access to the vials by users in a manner that does not require excessive contact with vial lids.

BRIEF SUMMARY OF THE INVENTION

Exemplary embodiments of the present disclosure pertain to an element of a vial transport assembly, the assembly comprising a plurality of the elements joined together to form a unitary row of elements. An object of the invention is to provide each element with an elongate member having inner and outer rectangular faces with a pair of side edges and a pair of end edges, the end edges significantly shorter than the side edges, and the inner and outer faces spaced apart to define a thickness. The elements have a means for receiving and retaining a vial, removably seated on the inner face to align an elongate axis of the vial received there in parallel to the side edges, and further a pair of end members, each end member arranged at one of the end edges, the end member extending normal to the inner face, each end member having lateral edges defining a trapezoidal profile.

Another object is to provide elements with complementary means, arranged along the side edges, for pivotally joining the element to another of the plurality of elements with the lateral edges of the end members of adjacent elements in registration.

An additional object of the present invention is to provide a gripper as the means for receiving and retaining the vial, the gripper having a rectangular portion having a pair of end edges, a pair of side edges shorter than the pair of side edges of the elongate member, and a bottom face in registration with the inner face when seated thereon. The gripper is provided with a pair of angled sides, each angled side arranged at one of the side edges of the rectangular bottom, and extending away from the bottom face and toward one another thereby forming a pair of congruent, interior, acute angles with respect to the bottom face. A channel is further provided having a cross section adapted to receive and retain the vial extending between the pair of angled sides in parallel to the pair of side edges of the rectangular portion.

A further object of the invention is to provide the gripper wherein the cross section of the channel comprises a circular arc subtending an angle greater than $\pi$ radians.

Another object of the invention is provided wherein the elongate member includes one or more holes extending through and normal to the inner and outer faces. For each hole, the gripper is further provided with a cylindrical base extending normal to the bottom face and having a diameter smaller than the hole and a length equal to or greater than the thickness of the elongate member, and a retention tab extending from a distal end of the cylindrical base and having a diameter greater than the hole.

Another object of the invention is to provide each attachment leg of the gripper with a tang extending from the retention tab for use in attaching the gripper to the element. In some embodiments, the gripper is formed of a unitary cast of silicone material. In others, the gripper is formed of a unitary injection molded thermoplastic elastomer.

An object of the invention is to provide a means to close a vial transport assembly composed of the elements during transportation. Two or more elements may be provided with complementary means, arranged along the lateral edges of each of the end members, for reversibly maintaining the lateral edges of the end members of adjacent elements in registration. In some embodiments, each end member is further provided with a pair of complementary magnets arranged for reversibly maintaining the lateral edges of the end members of adjacent elements in registration, each complementary magnet being inset within one of the lateral edges of the end members. In some embodiments, each end member is further provided with a pair of complementary magnets arranged for reversibly maintaining the lateral edges of the end members of adjacent elements in registration, each complementary magnet being secured to one of the lateral edges of the end members.

A further object of the invention is to provide a vial transport assembly from the vial transport elements. In some embodiments, a vial transport assembly is made of a first end element, a plurality of interior elements, and a second end element. Each of the end elements has an elongate member having inner and outer rectangular faces with a pair of side edges made of a free edge and a pivot edge, and a pair of end edges, the end edges significantly shorter than the side edges and the inner and outer faces spaced apart to define a thickness. The end elements further have a pair of end members, each end member arranged at one of the end edges, the end member extending normal to the inner face, each end member having an outer lateral edge and an interior lateral edge together defining a trapezoidal profile. The plurality of interior elements are each provided with an elongate member having inner and outer rectangular faces with a pair of pivot edges and a pair of end edges, the end edges significantly shorter than the pivot edges and the inner and outer faces spaced apart to define a thickness, and a pair of end members, each end member arranged at one of the end edges, the end member extending normal to the inner face, each end member having a pair of interior lateral edges defining a trapezoidal profile.

Another object of the invention is to form the vial transport assembly of a unitary row of adjacent elements formed by joining together the pivot edges of the first end elements, the plurality of interior elements and the second end element in succession, wherein the free edge of the first end element forms a first end of the unitary row and the free edge of the second end element forms a second end of the unitary row.

Another object is to provide the assembly with complementary means, arranged along the pivot edges, for pivotally coupling adjacent elements in the unitary row together, complementary means for reversibly maintaining the outer lateral edges of the first end element in registration with the outer lateral edges of the second end element, and means for receiving and retaining a vial, removably seated on the inner face of one or more elements in the assembly. In some embodiments, said means for receiving and retaining a vial is removably seated on the inner face of each of the elements in the assembly.

In some embodiments of the assembly, the complementary means for reversibly maintaining the outer lateral edges of the first and second end elements in registration is provided as a plurality of complementary magnets arranged for reversibly maintaining the outer lateral edges of the first and second end elements in registration, each complementary magnet being inset within one of the outer lateral edges therein.

In further embodiments of the assembly, the complementary means for reversibly maintaining the outer lateral edges of the first and second end elements in registration is provided as a plurality of complementary magnets arranged for reversibly maintaining the outer lateral edges of the first and second end elements in registration, each complementary magnet being secured to one of the outer lateral edges therein.

In some embodiments of the assembly, the plurality of interior elements is made up of exactly four interior elements. In those embodiments, each angle in the pair of angles may be less than or equal to 60 degrees.

An object of the invention is to provide a method of making a vial transport assembly, wherein the steps include providing a plurality of elements comprising an elongate member having inner and outer rectangular faces with a pair of side edges and a pair of end edges, the end edges significantly shorter than the side edges, and the inner and outer faces spaced apart to define a thickness, one or more holes extending through and normal to the inner and outer faces, a pair of end members, each end member arranged at one of the end edges, the end member extending normal to the inner face, each end member having lateral edges defining a trapezoidal profile, and complementary means, arranged along the side edges, for pivotally joining the element to another of the plurality of elements with the lateral edges of the end members of adjacent elements in registration. The side edges of the plurality of elements are pivotally joined together wherein a unitary row of elements is formed having a first end element and a second end element each with a free edge not pivotally joined to an adjacent element, and defining four lateral edges that are outer lateral edges.

A gripper is provided for each element having a rectangular portion having a pair of end edges, a pair of side edges, and a bottom face in registration with the inner face when seated thereon, a pair of angled sides, each angled side arranged at one of the side edges of the rectangular portion, and extending away from the bottom face and toward one another thereby forming a pair of angles congruent, interior, and acute with respect to the bottom face, a channel having a cross section adapted to receive and retain the vial extending between the pair of angled sides in parallel to the pair of side edges of the rectangular portion, and an attachment leg for each hole in the corresponding element. In some embodiments, each attachment leg is provided with a cylindrical base depending normally from the bottom face and having a diameter smaller than the hole and a length equal to or greater than the thickness of the elongate member, a retention tab extending from a distal end of the cylindrical base and having a width greater than the hole, and a tang extending from the retention tab.

Each gripper is removably seated on the inner face of each element in the unitary row of elements by inserting each tang and retention tab through a corresponding hole in the elongate member wherein the retention tab is seated upon the outer face thereof. Each tang is trimmed wherein it is separated from the gripper, and a plurality of complementary magnets are arranged on the outer lateral edges of the first and second end elements thereby reversibly maintaining the outer lateral edges in registration.

It is an object of this invention to provide a vial transport assembly and elements thereof of the type generally described herein, being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which:

FIG. 9 is an exploded perspective view of the element and the vial gripper thereof;

FIG. 10 is a perspective view of an exemplary embodiment of a vial gripper;

FIG. 11 is a perspective view of a second exemplary embodiment of a vial transport assembly shown in a partially folded position; and FIG. 12 is a perspective view thereof shown in a folded position.

DETAILED DESCRIPTION OF THE INVENTION

Exemplary embodiments of the present invention are directed to vial transport assemblies and elements thereof. While it has been discovered that the invention disclosed herein is of particular usefulness in the field of healthcare, it should be noted that use of the assembly is not considered limited thereto. To that end, references made throughout this disclosure to "vials" are to be interpreted to encompass containers, bottles and other such vessels for holding substances of generally any form, and not as limiting. The reference and depiction of medical vials generally is considered exemplary and for purposes of brevity and clarity no attempt has been made to describe numerous equivalents thereof.

Figure 1:
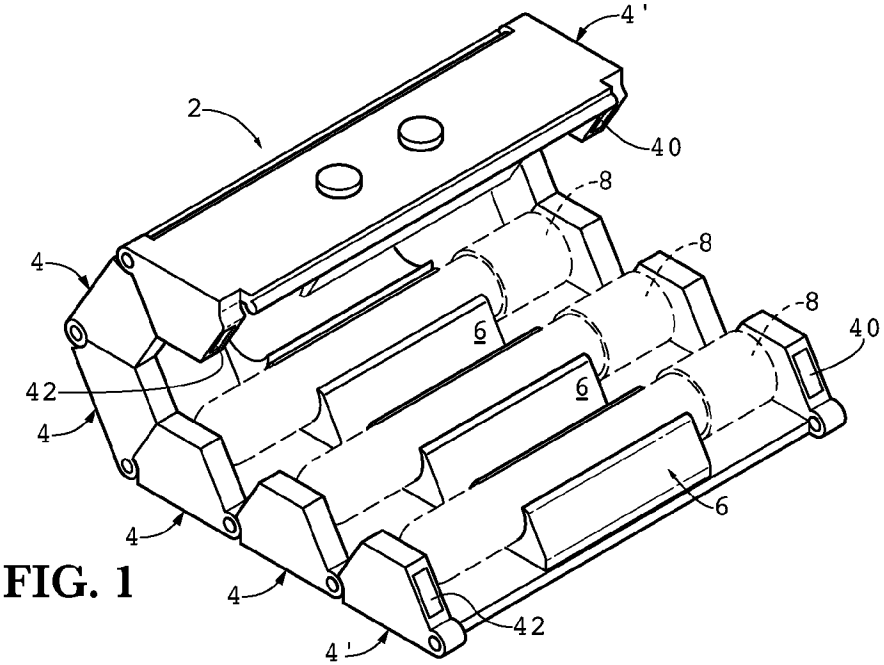
FIG. 1 is a perspective view of an exemplary embodiment of a vial transport assembly shown in a partially folded position.
Figure 2:
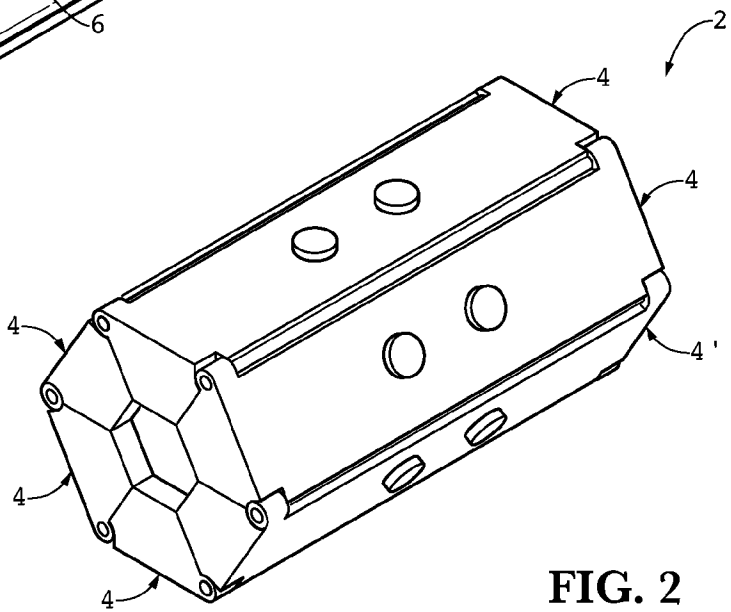
FIG. 2 is a perspective view thereof shown in a folded position.

A perspective view of an exemplary embodiment of a vial transport assembly 2 is depicted in FIG. 1 in a partially folded, or closed, position. FIG. 2 is a perspective view thereof in a fully folded position. When the assembly 2 is in a closed position, it protects items such as vials from damage and allows for convenient transportation and storage. The assembly 2 is formed from a plurality of elements 4 pivotally joined together to form a unitary row, such that the row of elements may be "folded" together end-to-end to generally form an enclosure, wherein the shape and number of elements selected for a particular embodiment of the invented vial transport assembly determines the shape of the folded assembly (e.g., the position of the assembly 2 in FIG. 2).

Embodiments of the invention include a means for receiving and retaining a vial 8 seated thereon, for example one or more grippers 6 as shown in FIGS. 1-2. In preferred embodiments, each element 4 is associated with a gripper 6 or other such means for receiving and retaining a vial seated thereon, but those skilled in the art will recognize that more or less may be used as suitable in light of various particular vial configurations. The gripper 6 or other means may be provided, in the case of elongate vials such as the vials 8 depicted in FIG. 1, to receive the vial in a manner so as to align its elongate axis in parallel with the side edges.

Figures 3, 4, 5, 6, 7, 8:
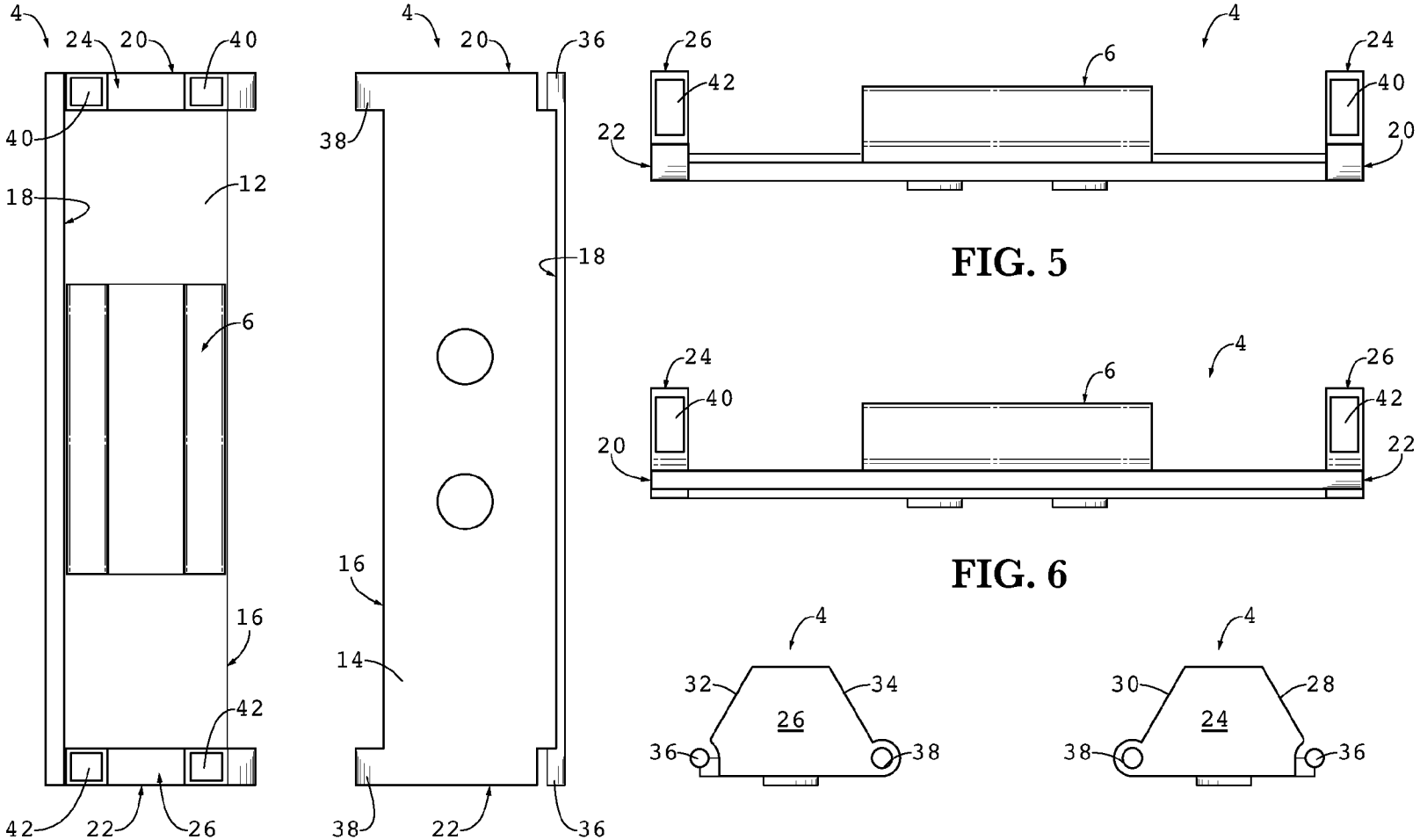
FIG. 3 is a top plan view of an element of an exemplary embodiment of the vial transport assembly.
FIG. 4 is a bottom plan view of the element thereof.
FIG. 5 is a rear elevation view of the element thereof.
FIG. 6 is a front elevation view of the element thereof.
FIG. 7 is a right side elevation view of the element thereof.
FIG. 8 is a left side elevation view of the element thereof.

FIGS. 3-8 are the orthogonal views of an exemplary embodiment of an element 4 of a vial transport assembly and an exemplary embodiment of an associated means 6 for receiving and retaining a vial 8 seated thereon. FIG. 3 is a top plan view, FIG. 4 is a bottom plan view, FIG. 5 is a rear elevation view, FIG. 6 is a front elevation view, FIG. 7 is a right side elevation view and FIG. 8 is a left side elevation view of the element 4. A plurality of such elements are joined together to form a vial transport assembly as described in further detail below.

The exemplary element 4 includes an elongate member that serves as one of a plurality of sides of the vial transport assembly when assembled. The elongate member includes inner 12 and outer 14 faces spaced apart in parallel such that a thickness is defined. In preferred embodiments, the inner and outer faces are rectangular in shape. When the vial transport assembly is closed, the inner faces 12 will face toward the center of the assembly generally, and the outer faces 14 will serve as an exterior surface of the assembly. The elongate member has generally a pair of parallel side edges 16 and 18, a pair of parallel end edges 20 and 22, and it is preferred that the side edges be substantially longer than the end edges.

At each end edge 20 and 22 is arranged an end member 24 and 26, respectively. The end members 24 and 26 each extend normal to the inner face 12 of the elongate member, and when the vial transport assembly is closed, form a portion of the ends of the vial transport assembly, together with the end members of other elements forming a unitary row. The shape of the end members in any particular embodiment may be selected to suit the requirements of a particular application, but they should generally at least be configured with a pair of lateral edges. For the exemplary embodiment of the element depicted in FIGS. 3-8, the lateral edges 28 and 30 correspond to the left end member 24 and the lateral edges 32 and 34 correspond to the right end member 26. The lateral edges may define a generally trapezoidal profile of the end member, as in the current embodiment, or may each extend further to intersect with one another, thereby defining a generally triangular profile.

Each element 4 is further provided with complementary means for pivotally joining the side edge of one element to the side edge of another adjacent element in such a manner that a unitary row is formed (e.g., the unitary row of elements 4 of the vial transport assembly 2 depicted in FIGS. 1-2). The complementary means for pivotally joining the side edges of adjacent elements in registration generally allows for the unitary row of elements to be folded (FIG. 2) for transport and storage, and unfolded (FIG. 1) for accessing the vials 8 stored therein (or to secure vials within the means for receiving and retaining the vial 6). In a preferred embodiment, the element 4 includes a pair of journal bearings, one at each end of the elongate member, which include a shaft portion 36 and a bearing portion 38. When a plurality of elements 4 are joined together to form a unitary row of elements, the shaft portion 36 at each end is secured within the corresponding bearing portion 38 of an adjacent element. Those skilled in the art will appreciate that other, comparable methods of pivotally joining adjacent elements may be employed without departing from the scope of the invention. For instance, piano hinges, barrel hinges or other hinge types generally may be affixed in various appropriate configurations at the side edges of the elongate member.

In some embodiments, the element is provided with complementary means, arranged along the lateral edges of each of the end members, for reversibly maintaining the lateral edges of the end members of adjacent elements in registration. This complementary means is employed to maintain the assembly of elements in a closed position. Some embodiments instead may include complementary mechanical latching means on the arranged on the end elements of a unitary row, but for pneumatic tube transport it is preferred that the means for reversibly maintaining the lateral edges of the end members of adjacent elements in registration does not protrude from the exterior surfaces of the assembly. An exemplary element 4 is further depicted with a pair of complementary magnets 40 and 42 secured at the lateral edges of each of the end members 24 and 26, respectively. A first pair of complementary magnets 40 is arranged on the lateral edges 28 and 30 of one end member 24, and a second pair of complementary magnets 42 is arranged on the lateral edges 32 and 34 of the other end member 26. The magnets are complementary in that one magnet in each pair 40 and 42 is attracted to the opposing magnet arranged on a lateral face of an adjacent element of a unitary row in registration. The magnets reversibly secure the edges of adjacent elements in order to maintain the assembly in a folded or closed position. In one embodiment, the magnets are inset within the lateral edges of the end members. Alternatively, the magnets can be attached to the surface of the lateral edges, for example with an appropriate adhesive. The complementary magnets 40 and 42 are shown with a rectangular shape, but any desired shape of magnet may be used without departing from the scope of the invention. For example, a circular inset is preferable, and thus in some embodiments circular magnets are used.

FIG. 9 is an exploded perspective view of an element 4 and a vial gripper 6. In general, the means for receiving and retaining a vial is preferably seated on the inner face of the element, and may be adapted for removal, if desired. A removably seated means for receiving and retaining a vial is advantageous as it allows the vial transport assembly to be reconfigured for carrying a variety of vial types, sizes, shapes, and the like. A variety of means for receiving and retaining a vial adapted for particular vials may be swapped during use, increasing the usefulness of the assembly. In one embodiment, the elongate member of the element 4 includes one or more holes 44 extending through and normal to the inner 12 and outer 14 rectangular faces. The vial gripper 6 has a corresponding number of attachment legs 46. Preferred embodiments are configured with at least two attachment leg and hole pairs in order to prevent unwanted movement/rotation of the gripper during use. Attachment legs are generally configured with a base portion and a retention tab portion, wherein the diameter of the retention tab portion is greater than the diameter of the base portion, and wherein diameter refers generally to the width of the base and retention tab portions, whether circular in shape or otherwise. The diameter of the retention tab portion is such that it may be pushed through the smaller-sized hole while also provided sufficient retaining force to hold the gripper when seated on the inner face of the corresponding element. It is preferable that the gripper be formed of a somewhat pliable material to provide these characteristics.

In some embodiments, such as in FIG. 10, the base 48 of each attachment leg is cylindrical, with a diameter smaller than the hole and a length equal to or greater than the thickness of the elongate member. A retention tab 50 at the distal end of the base 48 secures the vial gripper 6' to the element. In some embodiments, each attachment leg has a tang 52 extending from the retention tab 50. The tang 52 provides easier assembly of the vial transport assembly wherein the vial gripper 6' attaches to the element by inserting each tang 52 into a corresponding hole, providing a larger gripping area for an assembler's fingers to grip and pull the attachment leg through a hole until the bottom face of the gripper is seated on the inner face of the elongate member, and the tang 52 is trimmed off. The attachment legs or entire gripper 6' may be formed of an elastomer, so that the legs may be more readily inserted or removed through the holes.

The embodiment of the gripper 6' shown in FIG. 10 is configured for optimal use with standard blood vial sizes. This embodiment includes a rectangular portion having a pair of end edges 54, and pair of side edges 56 and a bottom face 58. In a vial transport assembly, the bottom face 58 is seated on (i.e., in registration with) the inner face of the element. A pair of angled sides 60 extend from the side edges upwardly and away from the bottom face, forming a pair of congruent, interior acute angles with respect to the bottom face. The two sides 60 angle inward toward each other, but do not touch, and a channel 62 is provided between the sides. The cross section of the channel 62 is shaped as a circular arc 64 corresponding to the circular shape of a particular vial (e.g., the vial 8 illustrated in FIG. 1). Those skilled in the art will appreciate that a variety of gripper shapes may be utilized without departing from the scope of the invention herein, so as to provide appropriate receiving and retaining means for many different vial shapes. In this exemplary embodiment, the cross section of the channel 62 is a circular arc 64 subtending an angle greater than $\pi$ (pi) radians, allowing the gripper 6' to receive and retain a vial securely. In some embodiments, the gripper 6' is formed of a unitary case of silicone material, and in others, the gripper 6' is formed of unitary injection-molded thermoplastic elastomer.

In preferred embodiments of the vial transport assembly, equal-sized elements are used for purposes of symmetry and in order to decrease manufacturing complexities and costs. In those cases, the end members are configured generally in isosceles trapezoid or triangle shapes. In this manner, the vial transport assembly, when closed, will form a polyhedron arranged in the shape of a right prism, and wherein the type of polygon base determined largely by the end member shape and number of elements. For example, the embodiments 2 and 66 depicted in FIGS. 1-2 and FIGS. 11-12, respectively, are formed with six elements, the end members are configured as isosceles trapezoids, and the assemblies fold into a generally hexagonal right prism shape with hexagon end surfaces having a smaller hexagonally-shaped void in the center.

FIGS. 11-12 is a perspective view of an exemplary embodiment of a vial transport assembly 66. FIG. 11 illustrates the assembly 66 shown in a partially folded position, and FIG. 12 illustrates the assembly 66 shown in a folded position. The elements are pivotally joined together along the side edges of adjacent elements. In this exemplary embodiment, complementary magnets 40 and 42 are attached to the end members of each element, reversibly holding the elements in a folded position when adjacent lateral edges are in registration. Alternatively, as depicted in FIG. 1, a single pair of complementary magnets is attached to the end members of the first 4' and second 4' end elements of the assembly 2, and not to the plurality of interior elements 4 that make up the unitary row. Note that FIG. 12 also illustrates the retention tabs 50 that are visible at the exterior of the assembly 66 when in the closed position.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An element for a vial transport assembly, the assembly comprising a plurality of the elements joined together to form a unitary row of elements, each element comprising:

an elongate member having inner and outer rectangular faces with a pair of side edges and a pair of end edges, the end edges significantly shorter than the side edges, and the inner and outer rectangular faces spaced apart to define a thickness;

means for receiving and retaining a vial, removably seated on the inner rectangular face to align an elongate axis of the vial received there in parallel to the side edges;

a pair of end members, each end member arranged at one of the end edges, each end member extending normal to the inner rectangular face, each end member having lateral edges defining a trapezoidal profile; and complementary means, arranged along the side edges, for pivotally joining the element to another of the plurality of elements with the lateral edges of the end members of adjacent elements in registration.

2. The element of claim 1, wherein the means for receiving and retaining the vial comprises a gripper comprising:

a rectangular portion having a pair of end edges, a pair of side edges shorter than the pair of side edges of the elongate member, and a bottom face in registration with the inner rectangular face when seated thereon;

a pair of angled sides, each angled side arranged at one of the side edges of the rectangular portion, and extending away from the bottom face and toward one another thereby forming a pair of congruent, interior, acute angles with respect to the bottom face; and a channel having a cross section adapted to receive and retain the vial extending between the pair of angled sides in parallel to the pair of side edges of the rectangular portion.

3. The element of claim 2, wherein the cross section of the channel comprises a circular arc subtending an angle greater than $\pi$ radians.

4. The element of claim 2, wherein the elongate member further comprises one or more holes extending through and normal to the inner and outer rectangular faces, and wherein the gripper further comprises, for each hole, an attachment leg comprising:

a cylindrical base extending normal to the bottom face and having a diameter smaller than the hole and a length equal to or greater than the thickness of the elongate member; and a retention tab extending from a distal end of the cylindrical base and having a diameter greater than the hole.

5. The element of claim 3, wherein the gripper is formed of a unitary cast of silicone material.

6. The element of claim 3, wherein the gripper is formed of a unitary injection molded thermoplastic elastomer.

7. The element of claim 1, further comprising complementary means, arranged along the lateral edges of each of the end members, for reversibly maintaining the lateral edges of the end members of adjacent elements in registration.

8. The element of claim 1, wherein each end member further comprises a pair of complementary magnets arranged for reversibly maintaining the lateral edges of the end members of adjacent elements in registration, each complementary magnet being inset within one of the lateral edges of the end member.

9. The element of claim 1, wherein each end member further comprises a pair of complementary magnets arranged for reversibly maintaining the lateral edges of the end members of adjacent elements in registration, each complementary magnet being secured to one of the lateral edges of the end member.

10. A vial transport assembly, comprising:

a first end element comprising:

an elongate member having inner and outer rectangular faces with a pair of side edges comprising a free edge and a pivot edge, and a pair of end edges, the end edges significantly shorter than the side edges and the inner and outer rectangular faces spaced apart to define a thickness; and a pair of end members, each end member arranged at one of the end edges, each end member extending normal to the inner rectangular face, each end member having an outer lateral edge and an interior lateral edge together defining a trapezoidal profile;

a plurality of interior elements, each comprising:

an elongate member having inner and outer rectangular faces with a pair of pivot edges and a pair of end edges, the end edges significantly shorter than the pivot edges and the inner and outer rectangular faces spaced apart to define a thickness; and a pair of end members, each end member arranged at one of the end edges, each end member extending normal to the inner rectangular face, each end member having a pair of interior lateral edges defining a trapezoidal profile;

a second end element comprising:

an elongate member having inner and outer rectangular faces with a pair of side edges comprising a free edge and a pivot edge, and a pair of end edges, the end edges significantly shorter than the side edges and the inner and outer rectangular faces spaced apart to define a thickness; and a pair of end members, each end member arranged at one of the end edges, each end member extending normal to the inner rectangular face, each end member having an outer lateral edge and an interior lateral edge together defining a trapezoidal profile, wherein a unitary row of adjacent elements is formed by joining together the pivot edges of the first end element, the plurality of interior elements and the second end element in succession, and wherein the free edge of the first end element forms a first end of the unitary row and the free edge of the second end element forms a second end of the unitary row;

complementary means, arranged along the pivot edges, for pivotally coupling adjacent elements in the unitary row together;

complementary means for reversibly maintaining the outer lateral edges of the first end element in registration with the outer lateral edges of the second end element; and means for receiving and retaining a vial, removably seated on the inner rectangular face of one or more elements.

11. The vial transport assembly of claim 10, wherein the means for receiving and retaining the vial comprises a gripper comprising:

a rectangular portion having a pair of end edges, a pair of side edges, and a bottom face in registration with the inner rectangular face when seated thereon;

a pair of angled sides, each angled side arranged at one of the side edges of the rectangular portion, and extending away from the bottom face and toward one another thereby forming a pair of angles congruent, interior and acute with respect to the bottom face; and a channel having a cross section adapted to receive and retain the vial extending between the pair of angled sides in parallel to the pair of side edges of the rectangular portion.

12. The vial transport assembly of claim 11, wherein the cross section of the channel comprises a circular arc subtending an angle greater than $\pi$ radians.

13. The vial transport assembly of claim 11, wherein the elongate member of each element in the plurality of elements further comprises one or more holes extending through and normal to the inner and outer rectangular faces, and wherein the gripper further comprises, for each hole, an attachment leg comprising:

a cylindrical base depending normally from the bottom face and having a diameter smaller than the hole and a length equal to or greater than the thickness of the elongate member; and a retention tab extending from a distal end of the cylindrical base and having a width greater than the hole.

14. The vial transport assembly of claim 13, wherein the gripper is formed of a unitary cast of silicone material.

15. The vial transport assembly of claim 13, wherein the gripper is formed of a unitary injection molded thermoplastic elastomer.

16. The vial transport assembly of claim 10, wherein the complementary means for reversibly maintaining the outer lateral edges of the first and second end elements in registration comprises a plurality of complementary magnets arranged for reversibly maintaining the outer lateral edges of the first and second end elements in registration, each complementary magnet being inset within one of the outer lateral edges therein.

17. The vial transport assembly of claim 10, wherein the complementary means for reversibly maintaining the outer lateral edges of the first and second end elements in registration comprises a plurality of complementary magnets arranged for reversibly maintaining the outer lateral edges of the first and second end elements in registration, each complementary magnet being secured to one of the outer lateral edges therein.

18. The vial transport assembly of claim 11, wherein the plurality of interior elements comprises exactly four interior elements.

19. The vial transport assembly of claim 18, wherein each angle in the pair of angles is less than or equal to 60 degrees.

20. A method of making a vial transport assembly comprising the steps:

providing a plurality of elements comprising:

an elongate member having inner and outer rectangular faces with a pair of side edges and a pair of end edges, the end edges significantly shorter than the side edges, and the inner and outer rectangular faces spaced apart to define a thickness;

one or more holes extending through and normal to the inner and outer rectangular faces;

a pair of end members, each end member arranged at one of the end edges, each end member extending normal to the inner rectangular face, each end member having lateral edges defining a trapezoidal profile; and complementary means, arranged along the side edges, for pivotally joining the element to another of the plurality of elements with the lateral edges of the end members of adjacent elements in registration;

pivotally joining the side edges of the plurality of elements together wherein a unitary row of elements is formed having a first end element and a second end element each with a free edge not pivotally joined to an adjacent element;

providing a gripper for each element in the unitary row of elements comprising:

a rectangular portion having a pair of end edges, a pair of side edges, and a bottom face in registration with the inner rectangular face when seated thereon;

a pair of angled sides, each angled side arranged at one of the side edges of the rectangular portion, and extending away from the bottom face and toward one another thereby forming a pair of angles congruent, interior and acute with respect to the bottom face;

a channel having a cross section adapted to receive and retain the vial extending between the pair of angled sides in parallel to the pair of side edges of the rectangular portion; and for each hole in a corresponding element, an attachment leg comprising:

a cylindrical base depending normally from the bottom face and having a diameter smaller than the hole and a length equal to or greater than the thickness of the elongate member;

a retention tab extending from a distal end of the cylindrical base and having a width greater than the hole; and a tang extending from the retention tab;

removably seating a gripper on the inner face of each element in the unitary row of elements by inserting each tang and retention tab of a gripper through a corresponding hole in the elongate member wherein the retention tab is seated upon the outer rectangular face thereof;

trimming each tang wherein it is separated from the gripper; and arranging a plurality of complementary magnets on an outer lateral edge of each end member of the first and second end elements wherein the outer lateral edge of each end member corresponds to the free edge of each of the first and second end elements whereby each of the outer lateral edges of the first end element are reversibly maintainable in registration with one of the outer lateral edges of the second end element.

* * * * *